US009788625B2

(12) United States Patent
De Benedictis et al.

(10) Patent No.: US 9,788,625 B2
(45) Date of Patent: Oct. 17, 2017

(54) HAIR STYLING DEVICE

(71) Applicant: TF3 LIMITED, Birmingham (GB)

(72) Inventors: Alfredo De Benedictis, Crumlin (GB); Mark Christopher Hughes, Worcestershire (GB)

(73) Assignee: TF3 LIMITED, Birmingham (GB)

( * ) Notice: Subject to any disclaimer, the term of this patent is extended or adjusted under 35 U.S.C. 154(b) by 176 days.

(21) Appl. No.: 14/673,424

(22) Filed: Mar. 30, 2015

(65) Prior Publication Data

US 2015/0201727 A1 Jul. 23, 2015

Related U.S. Application Data

(60) Continuation of application No. 14/246,079, filed on Apr. 5, 2014, now Pat. No. 9,027,570, which is a (Continued)

(30) Foreign Application Priority Data

Dec. 17, 2010 (GB) ..... 1021458.3

(51) Int. Cl.
*A45D 6/02* (2006.01)
*A45D 1/04* (2006.01)
(Continued)

(52) U.S. Cl.
CPC ..... *A45D 1/04* (2013.01); *A45D 1/06* (2013.01); *A45D 1/20* (2013.01); *A45D 2/02* (2013.01);
(Continued)

(58) Field of Classification Search
CPC ... A45D 6/00; A45D 6/02; A45D 2/02; A45D 2/10; A45D 2/362; A45D 2/367; A45D 2/36; A45D 1/06
See application file for complete search history.

(56) References Cited

U.S. PATENT DOCUMENTS 1,636,967 A 7/1927 Perry
1,806,711 A 5/1931 Salzman
(Continued)

FOREIGN PATENT DOCUMENTS

EP 1417906 A1 5/2004
EP 2392222 A1 12/2011
(Continued)

OTHER PUBLICATIONS

Feb. 4, 2015 Notice of Allowance issued in U.S. Appl. No. 14/246,079 by Rachel Running Steitz.
(Continued)

*Primary Examiner* — Rachel Steitz
(74) *Attorney, Agent, or Firm* — Hultquist, PLLC; Steven J. Hultquist

(57) ABSTRACT

This invention relates to a hair styling device having a body defining a chamber adapted to accommodate a length of hair, the length of hair being styled while it is located within the chamber. The chamber has a primary opening through which the length of hair may pass into the chamber. An elongate member is located within the chamber. A rotatable element is provided which is adapted to engage the length of hair adjacent to the primary opening and to apply a force to the length of hair to wind the length of hair around the elongate member. The rotation of the rotatable element is controlled by a control system which includes means to detect the force applied to the length of hair. In the event of hair entanglement the force applied to the length of hair increases and if the force detected by the control system exceeds a predetermined threshold the rotation of the rotatable element is stopped and can be reversed so as to relieve the tension and allow the length of hair to be removed from the device.

8 Claims, 5 Drawing Sheets

Related U.S. Application Data division of application No. 13/740,216, filed on Jan. 13, 2013, now Pat. No. 8,733,374, which is a continuation-in-part of application No. 13/639,053, filed as application No. PCT/GB2011/052506 on Dec. 16, 2011, now Pat. No. 8,651,118.

(51) Int. Cl.

| | |
|---|---|
| ***A45D 2/02*** | (2006.01) |
| ***A45D 2/10*** | (2006.01) |
| ***A45D 2/36*** | (2006.01) |
| ***A45D 1/06*** | (2006.01) |
| ***A45D 6/00*** | (2006.01) |
| ***A45D 1/20*** | (2006.01) |
| ***A45D 7/02*** | (2006.01) |

(52) U.S. Cl.

CPC ..... *A45D 2/10* (2013.01); *A45D 2/36* (2013.01); *A45D 2/362* (2013.01); *A45D 2/367* (2013.01); *A45D 6/00* (2013.01); *A45D 6/02* (2013.01); *A45D 7/02* (2013.01)

(56) References Cited

U.S. PATENT DOCUMENTS

| | | | | |
|---|---|---|---|---|
| 1,827,785 | A | | 10/1931 | Frederics |
| 1,831,487 | A | | 11/1931 | Elam |
| 1,877,776 | A | | 9/1932 | Pezzella |
| 1,884,305 | A | | 10/1932 | Shelton |
| 1,894,624 | A | | 1/1933 | Marcel |
| 1,895,653 | A | | 1/1933 | Fisher |
| 1,981,362 | A | | 11/1934 | Joyce |
| 2,595,844 | A | | 5/1952 | Graham |
| 2,791,225 | A | | 5/1957 | Simmons |
| 2,867,223 | A | | 1/1959 | Anzalone |
| 2,867,233 | A | | 1/1959 | Anzalone |
| 2,906,272 | A | | 9/1959 | Heidel |
| 2,935,070 | A | | 5/1960 | Auz |
| 3,213,859 | A | | 10/1965 | Mizell et al. |
| 3,213,860 | A | * | 10/1965 | Tewksbury ..... A45D 6/06 132/228 |
| 3,223,093 | A | | 12/1965 | Winters |
| 3,255,765 | A | | 6/1966 | Sturdivant |
| 3,786,819 | A | | 1/1974 | Cantrell |
| 3,805,810 | A | | 4/1974 | Savala |
| 3,835,292 | A | | 9/1974 | Walter et al. |
| 3,968,805 | A | | 7/1976 | Sobeck, Jr. |
| 4,148,330 | A | | 4/1979 | Gnaga |
| 4,177,824 | A | | 12/1979 | Gnaga |
| 4,222,398 | A | | 9/1980 | Fromman |
| 4,829,156 | A | | 5/1989 | Thompson |
| 4,884,583 | A | * | 12/1989 | Long, Jr. ..... A45D 6/04 132/238 |
| 5,119,847 | A | | 6/1992 | Powell et al. |
| 5,472,003 | A | | 12/1995 | Frame et al. |
| 5,584,309 | A | | 12/1996 | De Beneditis et al. |
| 5,771,906 | A | | 6/1998 | De Benedictis |
| 5,813,419 | A | | 9/1998 | Brams |
| 6,637,441 | B2 | | 10/2003 | Kennedy et al. |
| 6,647,989 | B1 | | 11/2003 | De Benedictis |
| 6,962,159 | B1 | | 11/2005 | Adam |
| 7,121,285 | B2 | | 10/2006 | Kraus |
| 7,198,049 | B2 | | 4/2007 | Elmer et al. |
| 7,305,995 | B2 | | 12/2007 | Tojo et al. |
| 7,487,783 | B2 | | 2/2009 | Saito et al. |
| 7,500,487 | B2 | | 3/2009 | Kobayashi et al. |
| 7,513,259 | B2 | | 4/2009 | Kimata et al. |
| 7,770,586 | B2 | | 8/2010 | Tojo et al. |
| 7,789,093 | B2 | | 9/2010 | Tojo et al. |
| 8,132,575 | B2 | | 3/2012 | Tojo et al. |
| 8,256,438 | B2 | | 9/2012 | Tojo et al. |
| 8,607,804 | B2 | | 12/2013 | De Benedictis |
| 8,651,118 | B2 | | 2/2014 | De Benedictis et al. |
| 2004/0231689 | A1 | | 11/2004 | Kobayashi et al. |
| 2004/0231690 | A1 | | 11/2004 | De Benedictis |
| 2004/0237991 | A1 | | 12/2004 | Glucksman et al. |
| 2005/0241663 | A1 | | 11/2005 | Getahun |
| 2005/0268933 | A1 | | 12/2005 | Kimata et al. |
| 2005/0284493 | A1 | | 12/2005 | Allen |
| 2006/0124148 | A1 | | 6/2006 | Tojo et al. |
| 2006/0157078 | A1 | | 7/2006 | Tojo et al. |
| 2007/0017541 | A1 | | 1/2007 | Wilmore |
| 2007/0065489 | A1 | | 3/2007 | Tojo et al. |
| 2007/0068547 | A1 | | 3/2007 | Gurth et al. |
| 2007/0084479 | A1 | | 4/2007 | Ryan-Jakimas |
| 2008/0035167 | A1 | | 2/2008 | Chan |
| 2008/0236610 | A1 | | 10/2008 | Bartels |
| 2008/0302381 | A1 | | 12/2008 | Tojo et al. |
| 2009/0056738 | A1 | | 3/2009 | Tojo et al. |
| 2010/0083978 | A1 | | 4/2010 | Hottenrott et al. |
| 2010/0170883 | A1 | | 7/2010 | Legrain et al. |
| 2011/0220141 | A1 | | 9/2011 | Chan |
| 2012/0186601 | A1 | | 7/2012 | Ungar et al. |
| 2013/0025621 | A1 | | 1/2013 | De Benedictis |
| 2013/0125919 | A1 | | 5/2013 | De Benedictis et al. |
| 2014/0076351 | A1 | | 3/2014 | De Benedictis et al. |
| 2014/0216494 | A1 | | 8/2014 | De Benedictis et al. |
| 2015/0000689 | A1 | | 1/2015 | De Benedictis |

FOREIGN PATENT DOCUMENTS

| | | | |
|---|---|---|---|
| FR | 641097 | A | 7/1928 |
| FR | 38041 | A | 3/1931 |
| GB | 1036583 | A | 7/1966 |
| GB | 1157814 | A | 7/1969 |
| GB | 302952 | A | 12/1978 |
| GB | 2413492 | A | 11/2005 |
| JP | 61-10102 | U | 1/1986 |
| JP | 2005324073 | A | 11/2005 |
| WO | 0008967 | A1 | 2/2000 |
| WO | 2005082198 | A1 | 9/2005 |
| WO | 2008102317 | A2 | 8/2008 |
| WO | 2008132345 | A2 | 11/2008 |
| WO | 2009077747 | A2 | 6/2009 |

OTHER PUBLICATIONS

Sep. 24, 2014 Office Action issued in U.S. Appl. No. 14/246,079 by Rachel Running Steitz.

Unpublished U.S. Appl. No. 14/400,538, filed Nov. 11, 2014.

Unpublished U.S. Appl. No. 14/673,327, filed Mar. 30, 2015.

Steenbeek, L.J., "Third Party Observations (Article 115 EPC)", Submitted to European Patent Office in Opposition Proceedings involving European Patent No. 2893832 issued on European Patent Application No. 15156384.8-1653, Jun. 29, 2016.

Van Der Scheer, Robbert, "Correspondence Concerning Investigation of Rowenta Curl Active, Model CF 6510 Product", Submitted in European Patent Office Opposition Proceedings involving European U.S. Pat. No. 2893832 ssued on European Patent Application No. 15156384.8-1653, Jun. 29, 2016.

* cited by examiner

HAIR STYLING DEVICE

CROSS-REFERENCE TO RELATED APPLICATIONS

This is a continuation application under the provisions of 35 USC 120 of U.S. patent application Ser. No. 14/246,079 filed Apr. 5, 2014, which is a divisional application under 35 USC 120 of U.S. patent application Ser. No. 13/740,216 filed Jan. 13, 2013 and issued as U.S. Pat. No. 8,733,374 on May 27, 2014, which in turn is a continuation-in-part under 35 USC 120 of U.S. patent application Ser. No. 13/639,053 filed Nov. 16, 2012 and issued as U.S. Pat. No. 8,651,118 on Feb. 18, 2014, which in turn is a U.S. national phase under 35 USC 371 of International Patent Application PCT/GB2011/052506 filed Dec. 16, 2011, which in turn claims priority of United Kingdom Patent Application 1021458.3 filed Dec. 17, 2010. The disclosures of U.S. patent application Ser. No. 14/246,079, U.S. patent application Ser. No. 13/740,216, U.S. patent application Ser. No. 13/639,053, International Patent Application PCT/GB2011/052506 and United Kingdom Patent Application 1021458.3 are hereby incorporated herein by reference in their respective entireties, for all purposes.

FIELD

This invention relates to a hair styling device, and in particular to an improvement upon the hair styling device disclosed in WO2009/077747.

For brevity, in the present application reference is made to the styling of a female's hair, but the invention is not limited thereby.

BACKGROUND

The hair styling device described in WO2009/077747 has a rotatable element which collects a length of hair to be styled, and winds the length of hair around an elongate member. The preferred embodiments described in WO2009/077747 utilise a chamber surrounding the elongate member, the chamber being heated by way of heat applied to the walls of the chamber and/or to the elongate member. The hair within the chamber becomes styled by the application of heat whilst it is located around the elongate member.

The present invention shares many of the features of the preferred embodiments of the hair styling device described in WO2009/077747, and so the disclosure of that document is incorporated herein in order to avoid unnecessary repetition.

In addition, it is believed that the hair styling device described in WO2009/077747 represents the closest prior art to the present invention.

SUMMARY

Notwithstanding the practical and commercial attractiveness of the hair styling devices described in WO2009/077747, the present inventors have conceived certain improvements and the present invention is directed to those improvements.

According to a first aspect of the present invention, there is provided a hair styling device having:

a body defining a chamber adapted to accommodate a length of hair, the chamber having a primary opening through which the length of hair may pass into the chamber; a rotatable element adapted to engage the length of hair adjacent to the primary opening;

an elongate member around which, in use, the length of hair is wound by the rotatable element, the elongate member having a free end;

the chamber having a secondary opening through which the length of hair may pass out of the chamber, the secondary opening being located adjacent to the free end; and a movable abutment which can engage the length of hair in use, the movable abutment having an open position in which the length of hair can pass through the secondary opening, and a closed position in which the length of hair is retained within the chamber.

The present invention therefore shares a feature of the hair styling device of WO2009/077747 in having a (primary) opening through which the length of hair passes into the chamber; the present invention differs in having a secondary opening adjacent to a free end of the elongate member. This permits the length of hair to be removed from the chamber without passing back through the primary opening.

Desirably, the secondary opening is annular and surrounds the free end of the elongate member. Such a secondary opening permits a formed curl to be slid off the end of the elongate member without being uncurled.

The inventors have realised that the avoidance of a requirement to force a wound curl to unwind as it is removed from the hair styling device has significant benefits in terms of the hair styling. Thus, since the chamber and therefore the hair is still hot as it is pulled out of the chamber, the hair continues to be styled as it is removed from the chamber, and a significant proportion (perhaps around 25% for example) of the curvature of a wound curl can be lost as the length of hair is pulled out of the chamber, despite the hair being subjected to only a small force during such removal.

The secondary opening can be permanently connected to the primary opening whereby a length of hair can pass from the primary opening to the secondary opening during operation of the device. The movable abutment can be located within the secondary opening whereby directly to prevent a wound length of hair from passing out of the chamber until the end of a styling operation. Alternatively, the movable abutment can be located within the primary opening, or between the primary and secondary openings. In these alternative embodiments the movable abutment can hold the length of hair away from the secondary opening until the end of a styling operation, and thereby indirectly prevent a wound length of hair from passing out of the secondary opening. Thus, it will be understood that the primary and secondary openings must be connected together if the length of hair is to enter the chamber through the primary opening and leave the chamber through the secondary opening, but it is not necessary that the openings are permanently interconnected.

According to a second aspect of the present invention, there is provided a hair styling device having:

a body defining a chamber adapted to accommodate a length of hair, the chamber having a primary opening through which the length of hair may enter the chamber;

a rotatable element adapted to engage the length of hair adjacent to the primary opening;

an elongate member around which, in use, the length of hair is wound by the rotatable element;

a movable panel having a closed position and an open position, the movable panel in the closed position overlying the primary opening, the movable panel having a pressing part which acts to press a portion of the length of hair towards the primary opening.

Whilst WO2009/077747 discloses an embodiment utilising a movable (door) panel to close off the (primary) opening, that document did not also disclose the use of a pressing part of the panel acting to press the hair towards the opening.

Desirably, the movable panel has two pressing parts, the pressing parts being spaced apart along the length of the primary opening. Desirably also, the device includes at least one inclined surface located adjacent to the primary opening, the movable panel being designed to cover the inclined surface(s) in its closed position, with the respective pressing parts lying adjacent to the inclined surface(s). In this way, as the panel is moved towards its closed position the pressing parts will drive the length of hair across the inclined surface (s) towards the primary opening, to better ensure that all of the hair is engaged and collected by the rotatable element. There may be two inclined surfaces, for example, the inclined surfaces converging towards the primary opening.

According to a third aspect of the present invention, there is provided a hair styling device having:

- a body defining a chamber adapted to accommodate a length of hair, the chamber having a primary opening through which the length of hair may pass;
- a rotatable element adapted to engage the length of hair adjacent to the primary opening;
- an elongate member around which, in use, the length of hair is wound by the rotatable element;
- a handle by which the device may be gripped by a user, the handle comprising a fixed handle part and a movable handle part, the fixed handle part being connected to the body and the movable handle part being movable relative thereto.

It is preferably arranged that the movable panel is connected to the movable handle part, so that a user can move the panel to its closed position simply by moving the movable handle part towards (or preferably into engagement with) the fixed handle part.

Desirably, the device is activated when the movable panel is moved to its closed position, i.e. the device carries a switch which is automatically actuated when the movable handle part reaches a predetermined position relative to the fixed handle part, or when the movable panel (or pressing part) reaches a predetermined position relative to the body. In this way, the device will not operate (and in particular the rotatable element will not move any of the length of hair) until the panel is in its closed position. As above indicated, pressing part(s) can act to press the length of hair towards the primary opening as the panel is moved towards its closed position, so increasing the likelihood that all of the hair is engaged and collected by the rotatable element. This reduces the likelihood of the hair becoming entangled, as entanglement is understood to occur only if the rotatable element engages and collects a portion of a length of hair but does not collect another portion of the length of hair.

According to a fourth aspect of the present invention, there is provided a hair styling device having:

- a body defining a chamber adapted to accommodate a length of hair, the chamber having a primary opening through which the length of hair may pass;
- a rotatable element adapted to engage the length of hair adjacent to the primary opening;
- an elongate member around which, in use, the length of hair is wound by the rotatable element;
- the body carrying at least one sensor adapted to detect misplaced hair.

For example, the end of an inclined surface opposed to the primary opening can carry a sensor which cooperates with the movable panel. The sensor is adapted to detect the presence of hair between the end of the inclined surface and the panel when the panel is in its closed position, it being determined that hair in such location might not be engaged and collected by the rotatable element and therefore might be likely to lead to entanglement.

According to a fifth aspect of the present invention, there is provided a hair styling device having:

- a body defining a chamber adapted to accommodate a length of hair, the chamber having a primary opening through which the length of hair may pass;
- a rotatable element adapted to engage the length of hair adjacent to the primary opening;
- an elongate member around which, in use, the length of hair is wound by the rotatable element;
- a control system which includes means to detect the load applied to the length of hair.

The present invention shares the benefits of WO2009/077747 in not applying tension to the length of hair during the styling process, so that the force required to rotate the rotatable element will be relatively small. However, if a portion of the length of hair becomes entangled the force will increase significantly, and this can be detected either by an increase in the current drawn by the motor, or preferably in a reduction in speed of the motor. The control system can be configured to react to a speed reduction (or load increase) above a certain threshold by reversing the rotation of the rotatable element.

In embodiments in which the rotatable element has a predetermined starting position, the control system can preferably reverse the rotatable element until it reaches the starting position. By arranging for the rotatable element to reverse, tension which has been put into the length of hair due to the entanglement will be relieved, and the tangled length of hair can be removed from the device (by way of the primary and/or secondary openings).

BRIEF DESCRIPTION OF THE DRAWINGS

The invention will now be described in more detail, by way of example, with reference to the accompanying drawings, in which.

DETAILED DESCRIPTION

Figure 1:
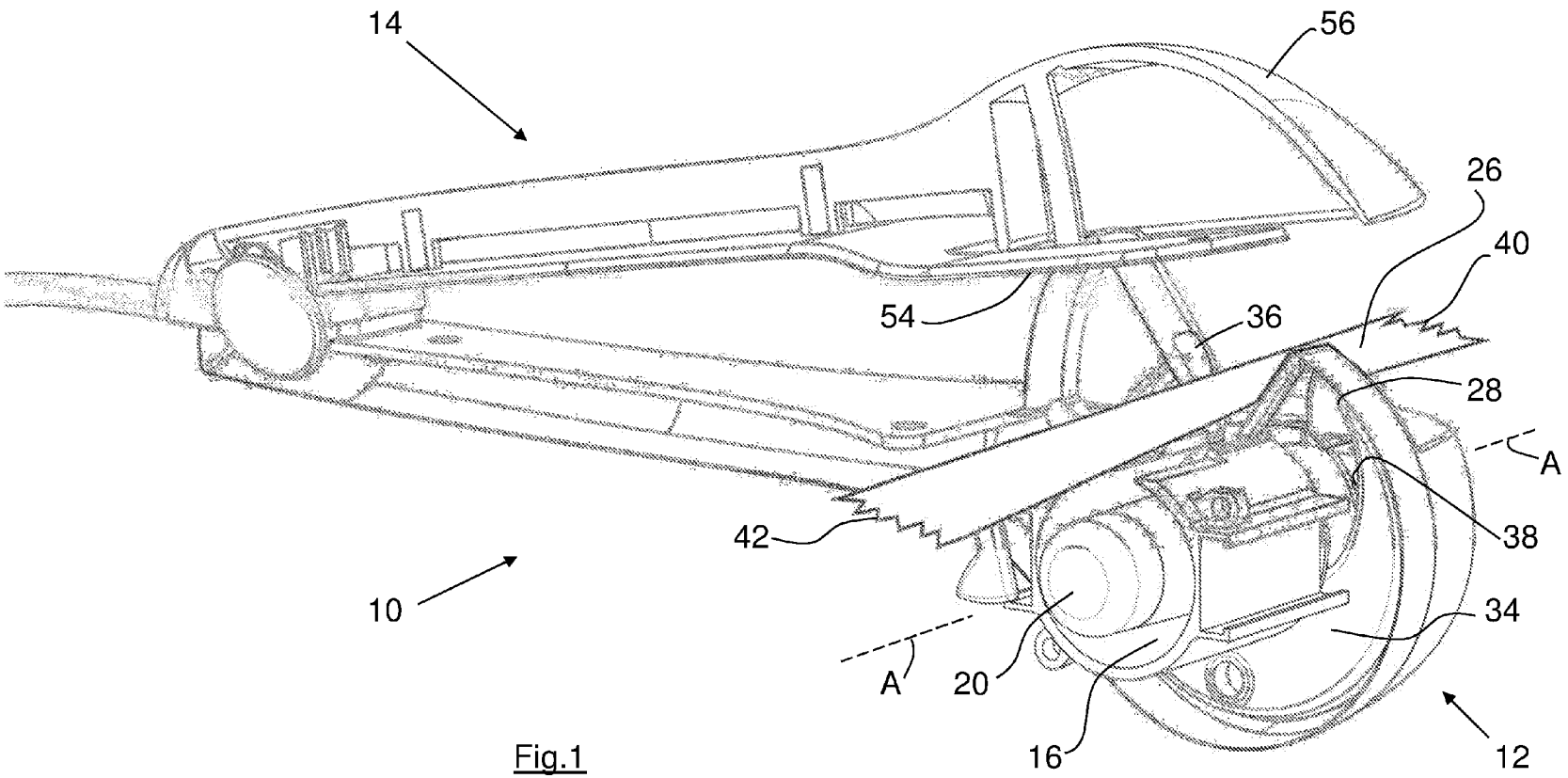
FIG. 1 shows a perspective view of a part of the hair styling device according to the present invention, with some of the body removed, and with a length of hair placed adjacent to the primary opening.

Whilst WO2009/077747 is included herein by reference, a brief description of the operation of the device is provided in relation to FIG. 1, so as to clarify the distinctions over the previous disclosure.

The hair styling device 10 has a body 12 and a handle 14. Within the body 12 is a chamber 16. An elongate member 20 is located within the chamber 16, the diameter of the elongate member 20, and the diameter of the wall 22 of the chamber, being chosen to produce curls of the desired curvature. (It will be understood that the elongate member 20, and the chamber 16, need not be of circular cross-section, and so the reference to "diameter" refers only to those circular embodiments).

Figure 2:
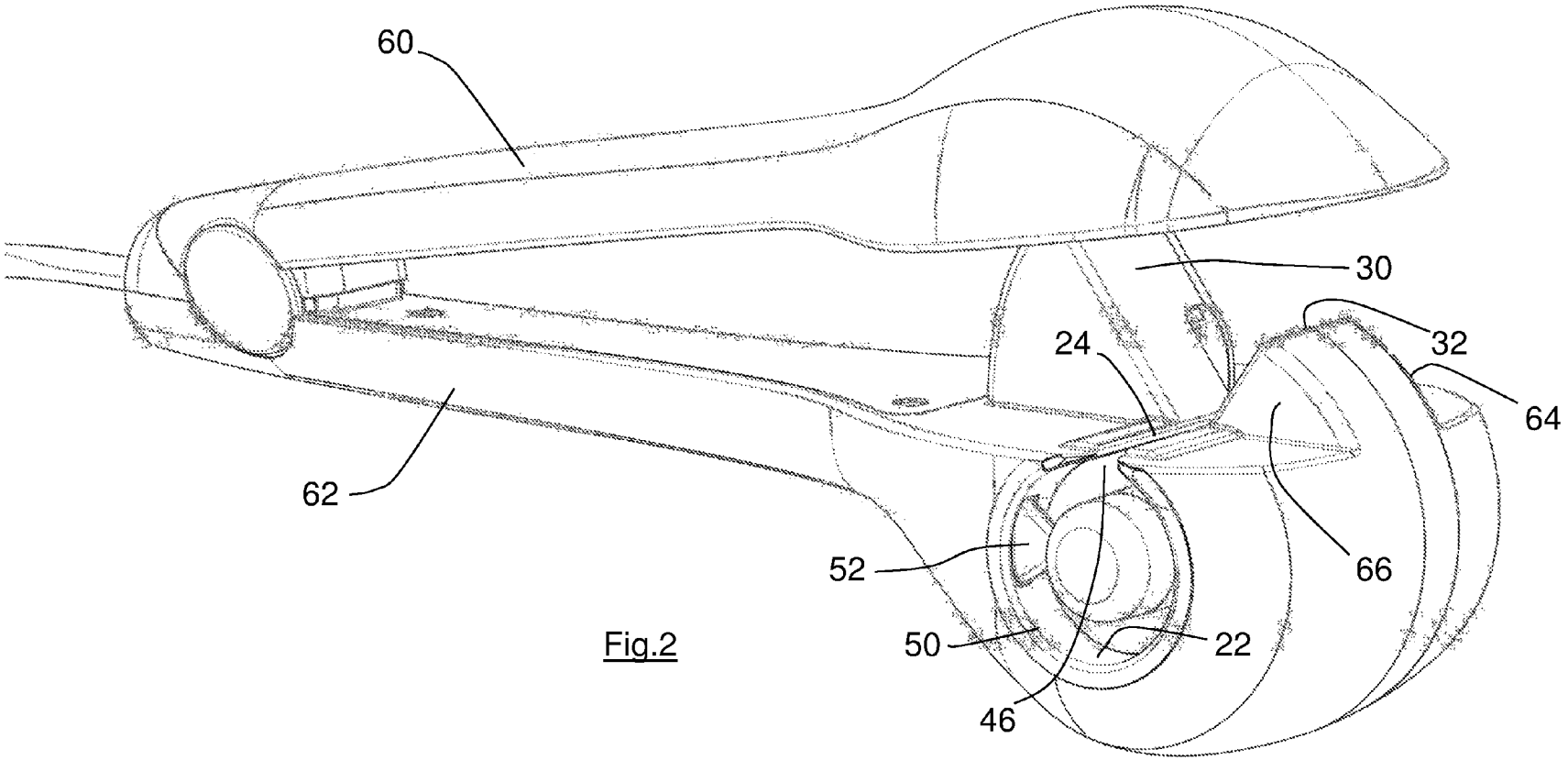
FIG. 2 shows the hair styling device of the invention including all of the body, in its condition ready to receive a length of hair to be styled.

The body 12 has a primary opening 24 (FIG. 2) through which a length of hair 26 may be introduced into the chamber 16. The introduction of a length of hair 26 into the device is facilitated by a pair of inclined surfaces 30 and 32, which lie to opposed sides of the primary opening 24. Only a part of each inclined surface 30 and 32 is shown in FIG. 1, the complete inclined surfaces 30 and 32 are shown in FIG. 2.

The device has a rotatable element 34 which can be driven to rotate about a longitudinal axis A-A. The rotatable element 34 projects beyond the primary opening 24, and the inclined surfaces 30 and 32 have cut-outs 36 formed therein to accommodate the rotatable element 34 during its rotation.

In this embodiment the longitudinal axis A-A around which the rotatable element 34 rotates is coincident with the axis of the elongate member 20, but that is not necessarily the case. Also, in this embodiment the elongate member 20 is fixed relative to the body 12, i.e. it does not rotate with the rotatable element, but that is also not necessarily the case, and in other embodiments the elongate member 20 rotates with the rotatable element.

As the rotatable element 34 rotates (counter-clockwise as drawn in FIG. 1), its leading end 28 passes over the length of hair 26 which lies adjacent to the primary opening 24, and its leading edge 38 (which is arcuate in this embodiment) engages and captures the length of hair 26. The form of the rotatable element 34 is such that it pulls the length of hair 26 through the primary opening 24 and into the chamber 16.

Considering the length of hair 26 shown in FIG. 1, the end 40 is the free end of the length of hair, and the part 42 is connected to the user's head (not shown). The hair styling device 10 is intended to impart curls to substantially all of the length of hair 26 lying between the part 42 and the free end 40, so that the numeral 42 represents the "end" of the length of hair 26 which will be styled by the device. Each of the individual hairs in the length of hair 26 will be connected to the user's scalp.

Figure 5:
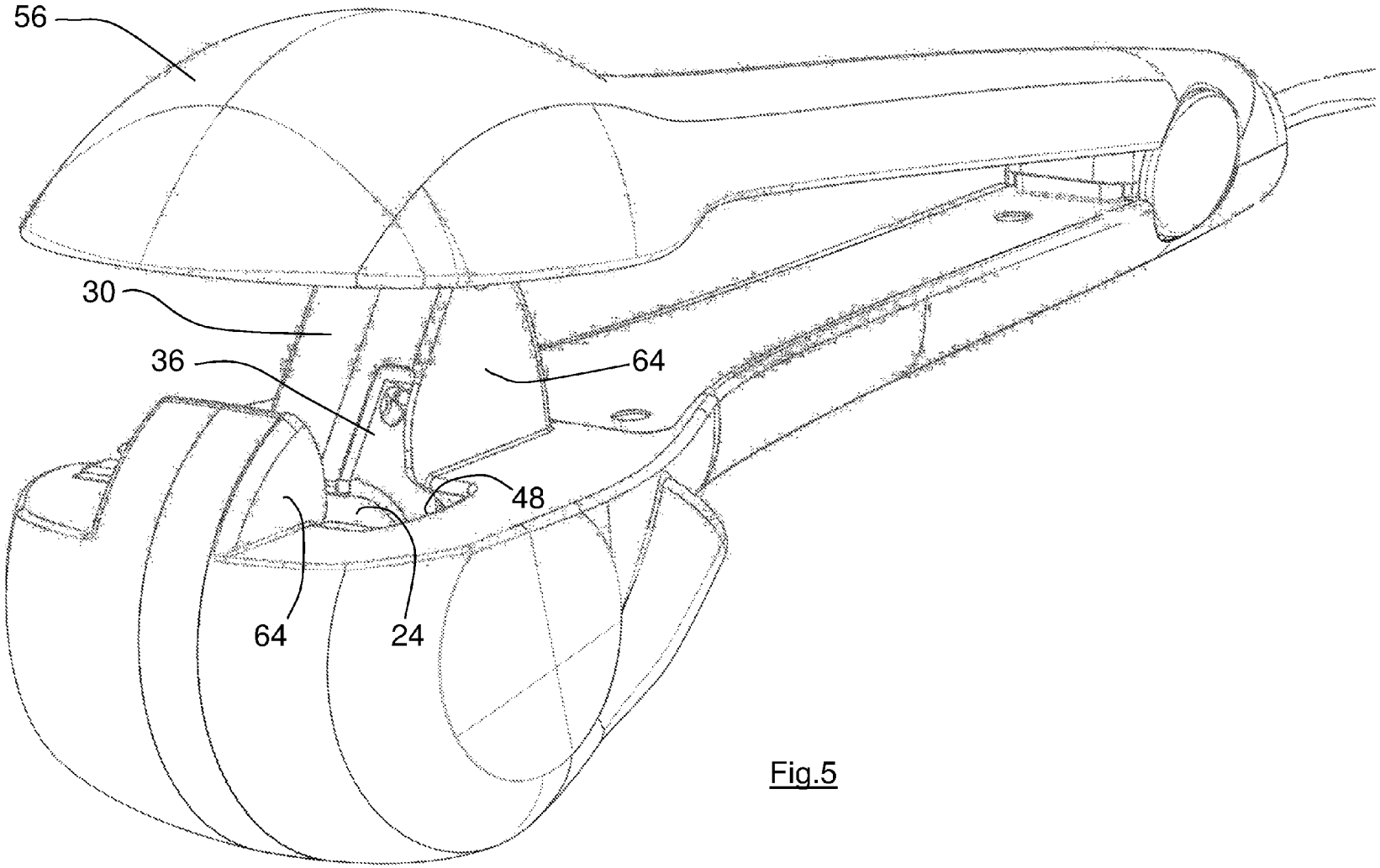
FIG. 5 shows another perspective view of the hair styling device.

As the rotatable element 34 rotates, the distal portion of the length of hair 26 (which lies between the rotatable element 34 and the free end 40), is pulled through the primary opening 24 to the far side of the rotatable element as drawn in FIG. 1 (to the right of the rotatable element as drawn in FIG. 5). As shown in FIG. 5, the primary opening 24 has a closed end 48 which provides a relatively fixed surface and it is the relative rotation between the rotatable element 34 and the primary opening 24 (and in particular its closed end 48) which causes the hair to be drawn into the device 10.

Figure 3:
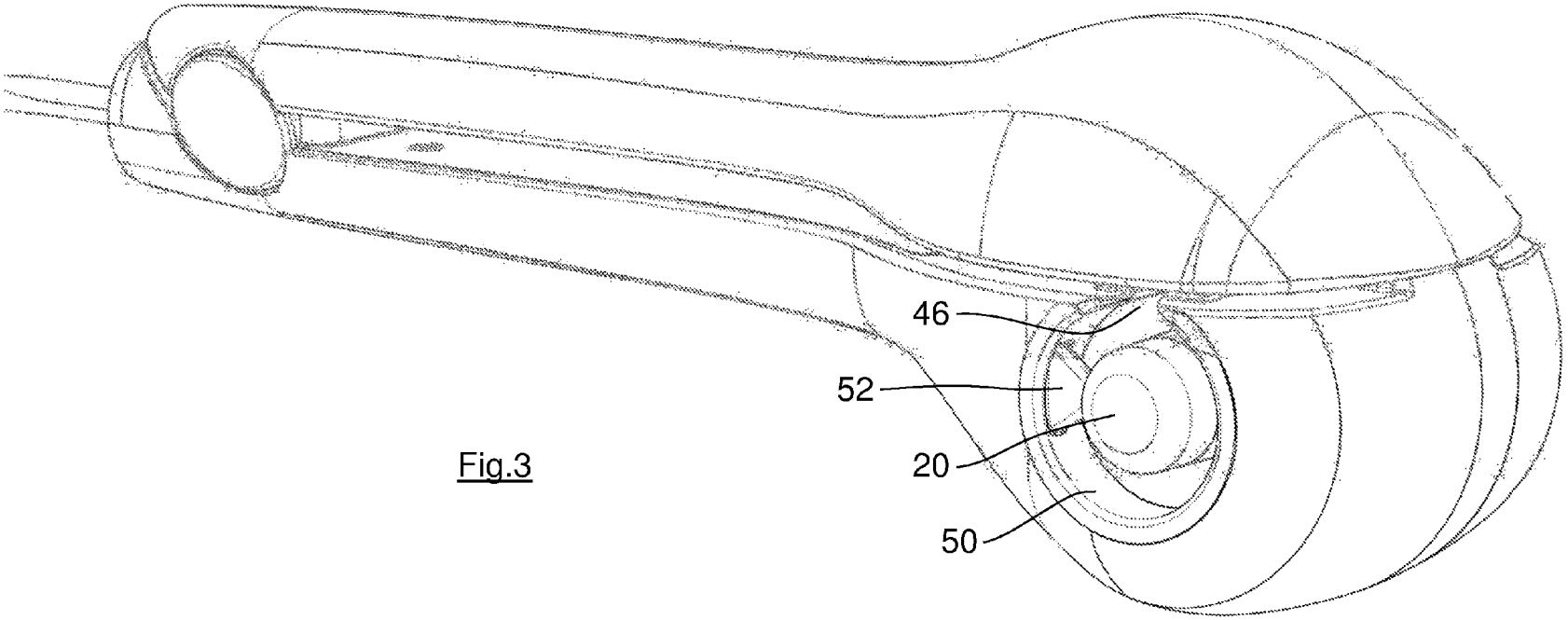
FIG. 3 shows the hair styling device in its condition during hair styling (although the length of hair is omitted from the drawing)

In this embodiment, the primary opening 24 is connected by a passageway 46 (FIG. 2) to a secondary opening 50. When the rotatable element 34 is rotated, the proximal portion of the length of hair (which lies between the rotatable element 34 and the part 42), will also be pulled through the primary opening 24 and into the chamber 16, to the near side of the rotatable element as viewed in FIG. 1 (to the left of the rotatable element as drawn in FIG. 5). In particular, the proximal portion is pulled through the primary opening 24, through the passageway 46, and subsequently through the secondary opening 50 to lie adjacent to the elongate member 20. Continued rotation of the rotatable element 34 drives the proximal portion of the length of hair 26 to rotate around the elongate member 20 until it engages the abutment 52 (FIGS. 2,3).

In common with the hair styling devices of WO2009/077747, the hair is not clamped by any part of the device 10. The part 42 of the length of hair 26 is, however, substantially fixed in position relative to the device 10. Accordingly, as the rotatable element 34 continues to rotate, the distal portion of the length of hair 26 is gradually pulled from the far side of the rotatable element 34 to the near side, as drawn in FIG. 1, until eventually all of the length of hair 26 is wound around the elongate member 20 between the rotatable element 34 and the abutment 52. It will be understood that it is the relative rotation between the rotatable element 34 and the abutment 52 which causes the distal portion of the length of hair to be drawn from the far side of the rotatable element to the near side of the rotatable element as drawn in FIG. 1.

The chamber 16 is preferably heated, either directly by way of one or more heating elements within the elongate member 20 and/or within the wall 22 of the chamber 16, or indirectly by way of hot air directed into the chamber 16, perhaps by a separate hair dryer. Other suitable means of generating heat can alternatively be used to heat the chamber indirectly, for example microwave radiation or electrical induction.

The panel 56 is connected to a "movable" handle part 60 which is hinged to a "fixed" handle part 62 (FIG. 2). The movable handle part 60 can be moved relative to the fixed handle part 62, and thereby the panel 56 can be moved relative to the body 12, between the open position shown in FIGS. 1,2,4 and 5 and the closed position shown in FIG. 3. In this preferred embodiment the movable handle part 60 is resiliently biased away from the fixed handle part 62, so that the user must clamp the handle parts 60 and 62 together in order to move the panel 56 to the closed position, and to retain it in that position during the styling procedure.

The hair styling device 10 is therefore particularly suited for use by a person styling her own hair, the user grasping the length of hair 26 with one hand and grasping (and operating) the hair styling device 10 with the other hand. The ability to grasp and manipulate the hair styling device 10 with one hand will also be advantageous for hairdressers and the like when using the device to style another person's hair.

When the length of hair 26 has been styled, for example by remaining within the heated chamber 16 for a predetermined length of time, the user can relax the grip upon the handle parts 60 and 62, permitting the resilient bias to move the panel 56 away from the body 12. In this embodiment it is arranged that the abutment 52 is spring-biased to its "open" position, and is driven to its "closed" position as the handle part 60 is moved towards the handle part 62. Accordingly, as the handle parts 60 and 62 are separated at the end of a styling operation, the abutment 52 automatically moves from the closed position shown in FIGS. 2 and 3 to its open position. It is arranged that the abutment 52 in its open position allows the styled length of hair to pass out of the secondary opening 50, i.e. to slide along the elongate member 20 towards and subsequently off its free end. Little force is required to separate the hair styling device 10 from the length of hair which has been styled, and because the secondary opening 50 is annular and surrounds the elongate member 20 the length of hair is not required to pass any obstruction or otherwise be forced to uncurl during its removal from the hair styling device 10, so that the curvature of the curls created by the device can be substantially maintained.

It has been recognised that the most significant likelihood of entanglement of the length of hair 26 is caused by a portion of the length of hair 26 being captured by the rotatable element 34, and another portion of the length of hair 26 not being captured by the rotatable element. In such circumstances the captured portion becomes wound around the elongate member 20 whereas the uncaptured portion does not. The present invention seeks to reduce the likelihood of such entanglement by increasing the likelihood that all of the length of hair 26 is captured by the rotatable element 34.

This is achieved at least in part by the provision of the inclined surfaces 30 and 32, which serve to guide the length of hair towards the primary opening 24. Additionally, the length of hair 26 is driven along the inclined surfaces, towards the primary opening 24, by pressing parts 54 (FIG. 4) located on the underside of the panel 56.

In this embodiment, it is arranged that the device is actuated automatically when the panel 56 is moved to its closed position, i.e. in addition to the abutment 52 being moved to its closed position, the rotatable element 34 begins to rotate, and the heating element(s) (not shown) are activated whereby to heat the chamber 16, when the handle parts 60 and 62 are brought together.

In other embodiments the handle part 60 or 62 can carry a switch for manual actuation of the device, the switch either having a single position in which the abutment 52 is moved to its closed position, the rotatable element 34 is rotated, and the heating element(s) are activated, or else separate sequential positions for each of these operations. In these embodiments it is preferably arranged that at least the rotatable element 34 cannot be rotated unless the panel 56 is in its closed position.

Figure 4:
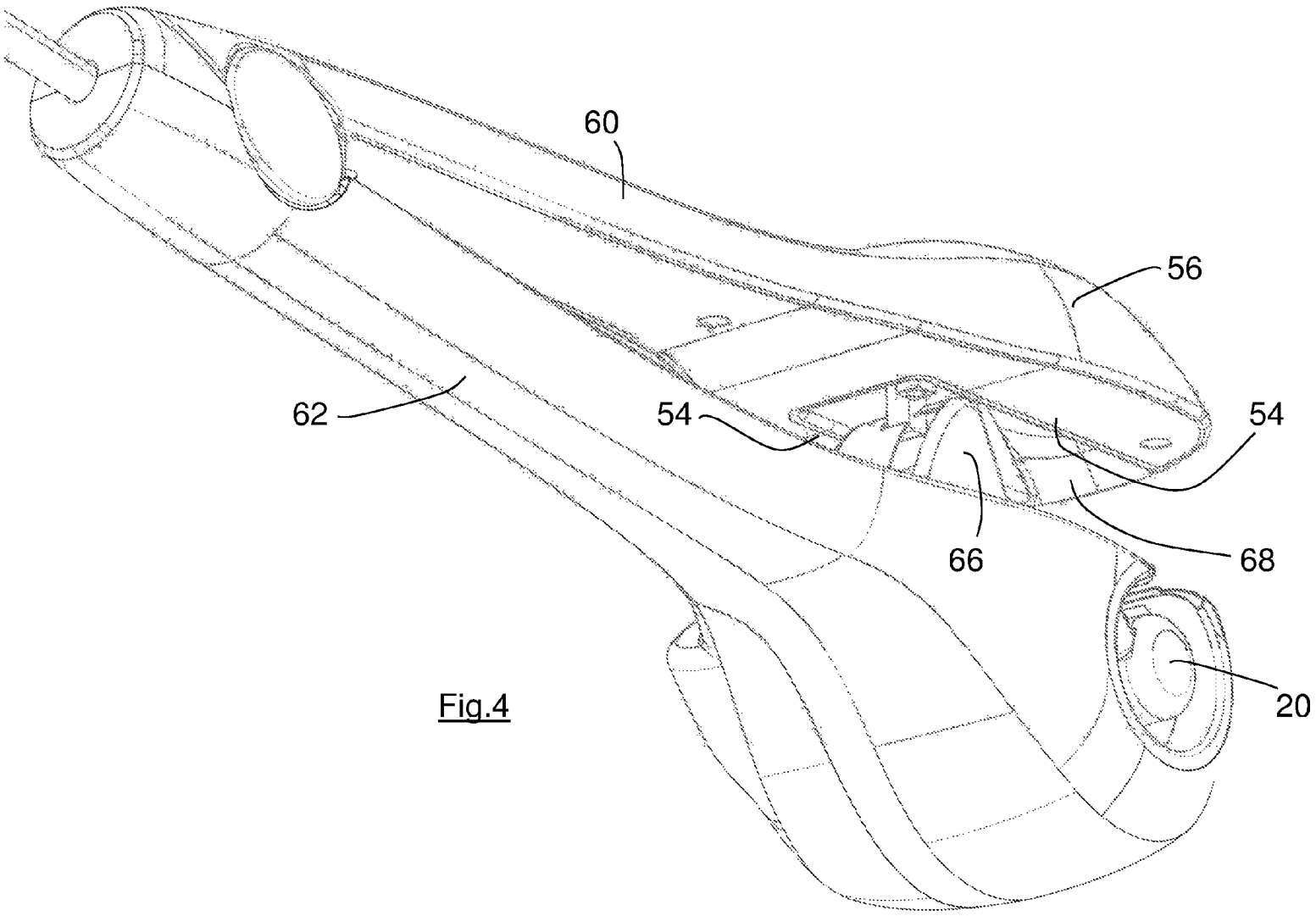
FIG. 4 shows a perspective view from below, including details of the panel and its pressing parts.

It is arranged that when the panel 56 is in its closed position as shown in FIG. 3, the pressing parts 54 lie close to the primary opening 24. The pressing parts 54 are spaced apart along the longitudinal axis A-A by a distance only slightly greater than the width of the inclined surfaces 30, 32, so that in the closed position the pressing parts lie close to the opposed sides 64, 66 of the inclined surfaces. In fact, as seen in FIG. 4, in this embodiment the pressing parts 54 surround a recess 68 in the panel 56 which is sized to accommodate the inclined surfaces 30 and 32 and the associated parts of the body 12.

It will therefore be understood that any of the length of hair 26 lying adjacent to the inclined surfaces 30,32 when the panel 56 is in its open position, will be driven by the pressing parts 54 along the inclined surfaces towards the primary opening 24 as the panel 56 is moved to its closed position. The length of hair 26 will therefore be held adjacent to the primary opening 24 as the rotatable element begins to rotate, whereby the likelihood of any portion of the length of hair not being captured by the rotatable element 34 is much reduced or eliminated.

It has been recognised that a portion of the length of hair might not be captured by the rotatable element 34 if it is placed beyond the end of the inclined surface 32. This might for example occur when the user is seeking to style her own hair and is unsighted, perhaps whilst styling the hair at the back of her head for example. In some embodiments of the invention, the body 12 can carry one or more sensors, suitably optical sensors, which can detect the presence of hair in unsuitable locations, and can prevent operation of the device until the misplaced hair is removed. In the embodiment shown, an optical transmitter 58 is positioned adjacent to the extreme end of the inclined surface 32, and a corresponding detector (not seen) is positioned on the underside of the panel 56. When the panel is closed any misplaced hair between the transmitter 58 and detector can prevent actuation of the rotatable element and cause the issuance of a warning signal to the user.

Reference is made above to the use of a sensor on the inclined surface 32, and it will be understood that in some embodiments it may be advantageous to provide one or more sensors also on the inclined surface 30. In the present embodiment, however, it is arranged that the separation of the handle parts 60,62 in their open position is insufficient to move the panel 56 away from the inclined surface 30 (alternatively stated, even when the handle parts 60 and 62 are in the fully open position as shown in FIGS. 1, 2, 4 and 5 the top of the inclined surface 30 still lies within the recess 68). The likelihood of any of the length of hair 26 being placed at or beyond the top of the inclined surface 30 is therefore very small. In some embodiments the top of the inclined surface can be shaped so as to reduce the likelihood of any of the length of hair 26 passing over the top of the inclined surface 30; the user may therefore press the length of hair against the inclined surface 30 in the knowledge that all of the length of hair will subsequently be captured by the rotatable element 34.

As stated above, the abutment 52 acts to prevent the proximal portion of the length of hair 26 from rotating around the free end of the elongate member 20, so that the length of hair 26 is curled or wound around the elongate member 20 rather than simply being twisted as the rotatable element rotates. It will be understood that it is not necessary for an abutment to close a part of the secondary opening 50 in order to perform this function, and in an alternative embodiment an abutment could be provided in the passageway 46, whereby to separate the primary opening 24 from the secondary opening 50. In another alternative the abutment could be provided at the proximal end of the primary opening 24, it being recognised that an abutment located anywhere between the rotatable element and the free end of the elongate member will perform this function.

If the abutment is located either in the passageway 46 or in the proximal end of the primary opening 24, it should be moved to its closed position before a length of hair is placed adjacent to the primary opening. The abutment should be moved to its open position (whereby to interconnect the primary and secondary openings) at the end of a styling operation, and in particular after the rotatable element 34 has stopped rotating, for example as the handle parts 60 and 62 are separated.

The rotatable element 34 is shown in its starting position in FIG. 1. It is arranged that the user can determine the number of rotations of the rotatable member necessary to draw all of the length of hair 26 into the chamber 16. When all of the hair has been drawn into the chamber 16 and the user switches off the rotatable element 34, the rotatable element automatically continues to its starting position.

It is another desirable feature of the hair styling device 10 that the device can automatically reverse the rotation of the rotatable element 34 in the event that the user's hair becomes entangled. For example, the control means of the device 10 (not seen) can measure the rate of rotation of the motor which drives the rotatable element 34. If the rate of rotation drops below a predetermined threshold this will indicate an unacceptable load being applied by the rotatable element, and the possible entanglement of the user's hair. In such circumstances, the control means can stop the rotatable element 34 and reverse it to the start position. The control means will also move the abutment member 52 to its open position. The reverse rotation of the rotatable element 34 will release any tension which has been applied to the length of hair and when the tension has been removed the length of hair can be removed from the device 10 and the entanglement released.

It is not necessary that the rotatable element 34 reverse all of the rotation which has been imparted into the length of hair. If, for example, the rotatable element has undertaken three rotations before the control means detects entanglement, it will preferably still only be reversed to its starting position and will not reverse past that starting position whereby to seek to remove all of the curls. The reason for this is that it is only necessary to remove the unwanted tension in the length of hair for it to be removed from the device 10, and it will be easier to release any entanglement once the length of hair 26 has been removed from the device. Seeking to remove all of the curls by reversing all of the rotations which have occurred will likely introduce more entanglement.

It will be understood that the secondary opening 50 could in an alternative embodiment be partially or fully closed by a part of the panel 56, i.e. the panel 56 could carry a projection which overlies the secondary opening. That is not preferred, however, as it is expected that the projection would have to be a very close sliding fit over the free end of the elongate member 20 in order to prevent any of the length of hair passing therebetween; any hair which did pass around the free end of the elongate member 20 would become twisted rather than curled, and would be liable to entanglement.

It will also be understood that the primary opening 24 does not need to remain open during the styling procedure, and in an alternative embodiment the primary opening could be closed as the handle parts 60 and 62 are brought together. In such an alternative embodiment the primary opening could be located at a position approximately 90° clockwise from the position shown in FIGS. 1 and 2 (i.e. at the "3 o'clock" position relative to the elongate member 20 rather than the "12 o'clock" position of FIGS. 1 and 2). The panel and body could have cooperating surfaces which define the primary opening when the device is in its open condition, the cooperating surfaces being brought together (or to overlap) when the device is in its closed position. In such embodiments, a portion of the length of hair would be located within the chamber before the rotatable element commences its rotation.

The present embodiment has two inclined surfaces 30 and 32, and it is expected that a hair styling device for personal use will preferably include two inclined surfaces which converge towards the primary opening 24. In another embodiment only the inclined surface 30 is provided, it being possible for a single inclined surface to provide the necessary guidance for a skilled user to position the length of hair adjacent to the primary opening, even if the user cannot see the length of hair. In addition, for hair styling aids which are primarily intended for professional use, neither of the inclined surfaces 30 and 32 may be required.

The invention claimed is:

1. A hair styling device having:

a body adapted to accommodate a length of hair, the body having a primary opening through which the length of hair may pass;

an elongate member;

a rotatable element adapted to engage the length of hair adjacent to the primary opening and to apply a load to the length of hair to wind the length of hair around the elongate member in use;

a control system adapted to detect the load applied to the length of hair, the control system having a record of a predetermined load threshold, and being configured to stop and then to reverse the rotation of the rotatable element when the detected load exceeds the threshold.

2. The hair styling device according to claim 1 in which the rotatable element is driven to rotate by an electric motor, and in which the control system is adapted to measure the electrical current drawn by the motor.

3. The hair styling device according to claim 1 in which the rotatable element is driven to rotate by a motor, and in which the control system is adapted to measure the rate of rotation of the motor.

4. The hair styling device according to claim 3 in which the control system has a record of a predetermined rate of rotation threshold and in which the control system is configured to stop and then to reverse the rotation of the rotatable element when the measured rate of rotation drops below the predetermined rate of rotation threshold.

5. The hair styling device according to claim 1 in which the rotatable element has a predetermined start position, and in which the control system is configured to reverse the rotatable element until it reaches the start position.

6. The hair styling device according to claim 1 in which the body has a secondary opening through which the length of hair may pass, the device having a movable abutment which can engage the length of hair in use, the movable abutment having an open position in which the length of hair can pass through the secondary opening and a closed position in which the length of hair is retained in the body, the control system being further configured to move the movable abutment to its open position when the detected load exceeds the threshold.

7. A method of operating a hair styling device having a body adapted to accommodate a length of hair, the body having a primary opening through which the length of hair may pass, an elongate member, a rotatable element located adjacent to the primary opening, and a control system adapted to control the rotation of the rotatable element, the method comprising:

{i} locating a chosen length of hair adjacent to the primary opening;

{ii} rotating the rotatable element;

{iii} applying a load to the length of hair by way of the rotatable element and winding the length of hair around the elongate member;

{iv} detecting the load applied to the length of hair;

{v} comparing the detected load with a predetermined threshold;

{vi} stopping the rotation of the rotatable element if the detected load exceeds the predetermined threshold;

{vii} reversing the rotation of the rotatable element if the detected load exceeds the predetermined threshold.

8. The method of claim 7 in which the rotatable element has a predetermined start position and in which the rotatable element is reversed back to the start position.

* * * * *